US011128949B2

(12) United States Patent
Chang et al.

(10) Patent No.: US 11,128,949 B2
(45) Date of Patent: Sep. 21, 2021

(54) PASSIVE RADIATOR

(71) Applicant: QISDA CORPORATION, Taoyuan (TW)

(72) Inventors: Kai-Jung Chang, Taoyuan (TW); Chih-Hung Lin, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 16/412,424

(22) Filed: May 15, 2019

(65) Prior Publication Data

US 2020/0228892 A1 Jul. 16, 2020

(30) Foreign Application Priority Data

Jan. 14, 2019 (CN) ..... 201910030998.2

(51) Int. Cl.
*H04R 1/28* (2006.01)
*H04R 31/00* (2006.01)
*H04R 7/14* (2006.01)

(52) U.S. Cl.
CPC ..... *H04R 1/2834* (2013.01); *H04R 1/2819* (2013.01); *H04R 7/14* (2013.01); *H04R 31/003* (2013.01); *H04R 2400/11* (2013.01)

(58) Field of Classification Search
CPC ..... H04R 1/2834; H04R 1/2819; H04R 7/14; H04R 31/003; H04R 2400/11
See application file for complete search history.

(56) References Cited

U.S. PATENT DOCUMENTS 3,997,023 A * 12/1976 White ..... G10K 13/00 181/171
5,418,337 A * 5/1995 Schreiber ..... H04R 7/12 181/171
5,455,396 A * 10/1995 Willard ..... H04R 7/20 181/172
6,305,491 B2 * 10/2001 Iwasa ..... H04R 7/20 181/166
6,460,651 B1 * 10/2002 Sahyoun ..... H04R 1/2834 181/157
7,218,748 B1 * 5/2007 Stompler ..... H04R 7/18 181/172

(Continued)

FOREIGN PATENT DOCUMENTS

CN 108600925 * 2/2018 ..... H04R 9/06
CN 108600925 * 9/2018 ..... H04R 1/28

*Primary Examiner* — Oyesola C Ojo

(57) ABSTRACT

A passive radiator includes a frame, a vibrating member, a surround and a plurality of strengthening ribs. The vibrating member is disposed in the frame. The surround includes a first arc portion and a second arc portion. The first arc portion is connected to the frame. The second arc portion is connected to the vibrating member. The first arc portion and the second arc portion are connected to form an S shape. The strengthening ribs are connected to the first arc portion and the second arc portion. A thickness of the strengthening rib corresponding to the first arc portion is larger than a thickness of the strengthening rib corresponding to the second arc portion. Furthermore, the passive radiator may include a plurality of reinforcing ribs connected to the first arc portion. Moreover, a thickness of the first arc portion may be larger than a thickness of the second arc portion.

14 Claims, 3 Drawing Sheets

(56) References Cited

U.S. PATENT DOCUMENTS

| | | | | |
|---|---|---|---|---|
| 7,931,115 | B2 * | 4/2011 | Silver | H04R 7/20 181/171 |
| 8,397,861 | B1 * | 3/2013 | Xu | H04R 7/18 181/171 |
| 10,171,913 | B2 * | 1/2019 | Nicoletti | H04R 31/003 |
| 2007/0201712 | A1 * | 8/2007 | Saiki | H04R 1/2834 381/186 |
| 2013/0044909 | A1 * | 2/2013 | Jeffery | H04R 1/025 381/395 |
| 2013/0213628 | A1 * | 8/2013 | Litovsky | H04R 1/2834 165/185 |
| 2014/0355806 | A1 * | 12/2014 | Graff | H04R 1/02 381/334 |
| 2016/0316298 | A1 * | 10/2016 | Ohura | H04R 1/2834 |
| 2018/0192173 | A1 * | 7/2018 | Graff | H04R 1/2834 |
| 2018/0242084 | A1 * | 8/2018 | Fuller | H04R 1/02 |
| 2018/0310082 | A1 * | 10/2018 | Amae | H04R 1/021 |
| 2020/0275210 | A1 * | 8/2020 | Huang | H04R 31/003 |

* cited by examiner

PASSIVE RADIATOR

BACKGROUND OF THE INVENTION

1. Field of the Invention

The invention relates to a passive radiator and, more particularly, to a passive radiator capable of enhancing bass effect effectively.

2. Description of the Prior Art

A passive radiator is usually installed in a speaker box to enhance bass effect. When a speaker unit vibrates to output sound, the air in the speaker box is compressed or expanded to drive a diaphragm of the passive radiator to vibrate, so as to enhance bass effect. In general, the diaphragm is fixed to the frame by a surround. When the diaphragm vibrates, a tension force of the outside of the surround (i.e. an end of the surround away from the diaphragm) is smaller than a tension force of the inside of the surround (i.e. an end of the surround close to the diaphragm), such that a return force is unbalanced when the diaphragm vibrates. Therefore, the bass effect generated by the diaphragm may get worse.

SUMMARY OF THE INVENTION

An objective of the invention is to provide a passive radiator capable of enhancing bass effect effectively, so as to solve the aforesaid problems.

According to an embodiment of the invention, a passive radiator comprises a frame, a vibrating member, a surround and a plurality of strengthening ribs. The vibrating member is disposed in the frame. The surround comprises a first arc portion and a second arc portion. The first arc portion is connected to the frame and the second arc portion is connected to the vibrating member. The first arc portion and the second arc portion are connected to form an S shape. The strengthening ribs are connected to the first arc portion and the second arc portion. A thickness of the strengthening rib corresponding to the first arc portion is larger than a thickness of the strengthening rib corresponding to the second arc portion.

According to another embodiment of the invention, a passive radiator comprises a frame, a vibrating member, a surround and a plurality of reinforcing ribs. The vibrating member is disposed in the frame. The surround comprises a first arc portion and a second arc portion. The first arc portion is connected to the frame and the second arc portion is connected to the vibrating member. The first arc portion and the second arc portion are connected to form an S shape. The reinforcing ribs are connected to the first arc portion.

According to another embodiment of the invention, a passive radiator comprises a frame, a vibrating member and a surround. The vibrating member is disposed in the frame. The surround comprises a first arc portion and a second arc portion. The first arc portion is connected to the frame and the second arc portion is connected to the vibrating member. The first arc portion and the second arc portion are connected to form an S shape. A thickness of the first arc portion is larger than a thickness of the second arc portion.

As mentioned in the above, the invention may selectively increase the thickness of the strengthening rib corresponding to the first arc portion, add the reinforcing rib to the first arc portion, and/or increase the thickness of the first arc portion, so as to balance a tension force difference between the first arc portion (i.e. an end of the surround away from the vibrating member) and the second arc portion (i.e. an end of the surround close to the vibrating member), such that a return force is more balanced when the vibrating member vibrates. Accordingly, the bass effect generated by the vibrating member can be enhanced effectively.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
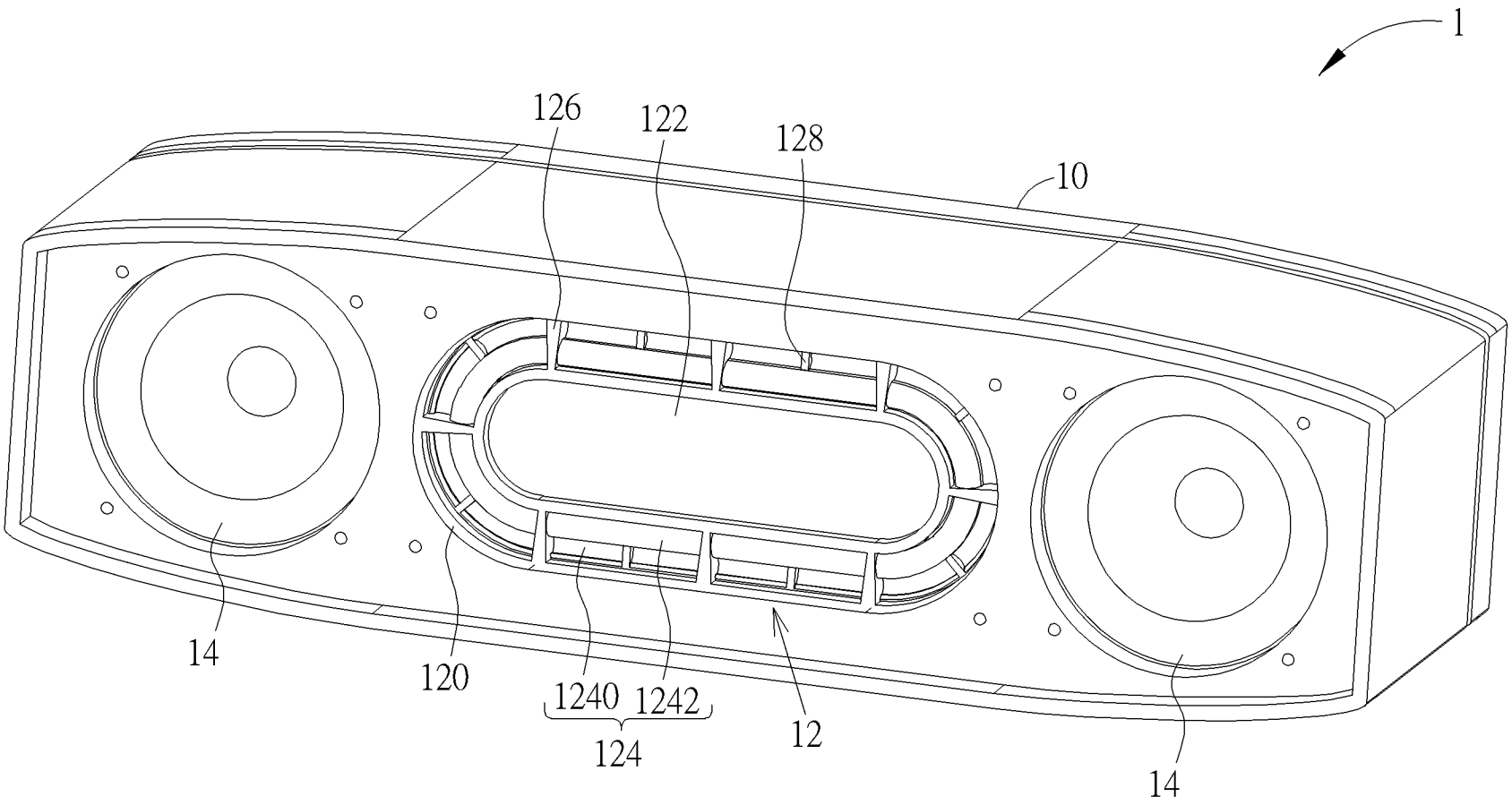
FIG. 1 is a perspective view illustrating a speaker box equipped with a passive radiator according to an embodiment of the invention.
Figure 2:
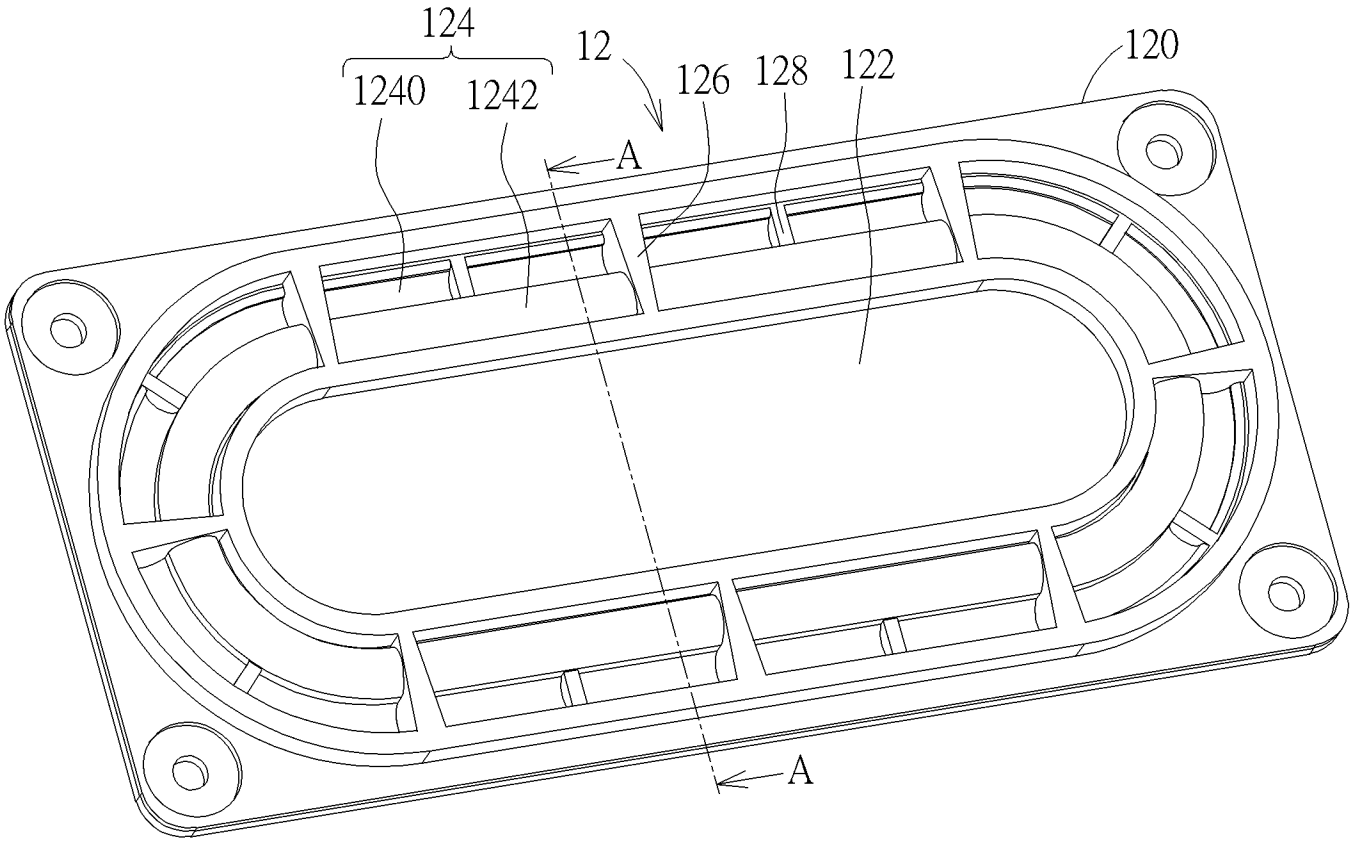
FIG. 2 is a perspective view illustrating the passive radiator shown in FIG. 1.
Figure 3:
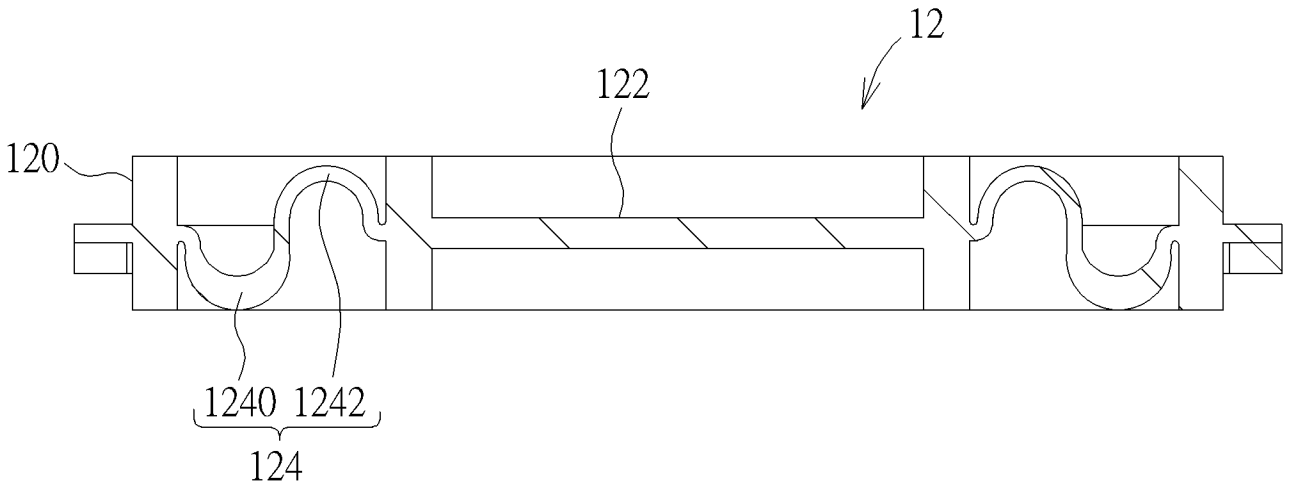
FIG. 3 is a sectional view illustrating the passive radiator along line X-X shown in FIG. 2.

Referring to FIGS. 1 to 3, FIG. 1 is a perspective view illustrating a speaker box 1 equipped with a passive radiator 12 according to an embodiment of the invention, FIG. 2 is a perspective view illustrating the passive radiator 12 shown in FIG. 1, and FIG. 3 is a sectional view illustrating the passive radiator 12 along line X-X shown in FIG. 2.

As shown in FIG. 1, the speaker box 1 comprises a box body 10, a passive radiator 12 and two speaker units 14. The passive radiator 12 and the speaker units 14 are disposed on the box body 10. In this embodiment, the passive radiator 12 may be disposed between the two speaker units 14, but is not so limited. It should be noted that the number of the speaker units 14 may be determined according to practical applications, so the invention is not limited to the embodiment shown in the figure.

As shown in FIGS. 2 and 3, the passive radiator 12 comprises a frame 120, a vibrating member 122, a surround 124, a plurality of strengthening ribs 126 and a plurality of reinforcing ribs 128. In this embodiment, the vibrating member 122 may be a diaphragm or the like.

The vibrating member 122 is disposed in the frame 120. The surround 124 comprises a first arc portion 1240 and a second arc portion 1242. The first arc portion 1240 is connected to the frame 120 and the second arc portion 1242 is connected to the vibrating member 122. Furthermore, the first arc portion 1240 and the second arc portion 1242 are connected to form an S shape. Accordingly, the first arc portion 1240 is located at the outside of the surround 124 and away from the vibrating member 122, and the second arc portion 1242 is located at the inside of the surround 124 and close to the vibrating member 122. The surround 124 is configured to provide a return force when the vibrating member 122 vibrates.

The strengthening ribs 126 are connected to the first arc portion 1240 and the second arc portion 1242. In this embodiment, the strengthening ribs 126 may be arranged symmetrically. It should be noted that the arrangement of the strengthening ribs 126 may be determined according to practical applications, so the invention is not limited to the embodiment shown in the figure. As shown in FIG. 2, a thickness of the strengthening rib 126 corresponding to the first arc portion 1240 is larger than a thickness of the strengthening rib 126 corresponding to the second arc portion 1242. In this embodiment, the thickness of the strengthening rib 126 may decrease gradually from the first arc portion 1240 to the second arc portion 1242. However, in another embodiment, the strengthening rib 126 corresponding to the first arc portion 1240 may have a fixed thickness T1, the strengthening rib 126 corresponding to the second arc portion 1242 may have a fixed thickness T2, and the fixed thickness T1 is larger than the fixed thickness T2.

Furthermore, as shown in FIG. 2, the reinforcing ribs 128 are connected to the first arc portion 1240. In this embodiment, the reinforcing ribs 128 and the strengthening ribs 126 may be arranged interlacedly and symmetrically. It should be noted that the arrangement of the reinforcing ribs 128 and the strengthening ribs 126 may be determined according to practical applications, so the invention is not limited to the embodiment shown in the figure. Moreover, as shown in FIG. 3, a thickness of the first arc portion 1240 is larger than a thickness of the second arc portion 1242.

By means of increasing the thickness of the strengthening rib 126 corresponding to the first arc portion 1240, adding the reinforcing rib 128 to the first arc portion 1240, and increasing the thickness of the first arc portion 1240, a tension force difference between the first arc portion 1240 (i.e. an end of the surround 124 away from the vibrating member 122) and the second arc portion 1242 (i.e. an end of the surround 124 close to the vibrating member 122) can be balanced, such that a return force is more balanced when the vibrating member 122 vibrates. Accordingly, the bass effect generated by the vibrating member 122 can be enhanced effectively.

In another embodiment, the invention may only increase the thickness of the strengthening rib 126 corresponding to the first arc portion 1240, so as to balance a tension force difference between the first arc portion 1240 (i.e. an end of the surround 124 away from the vibrating member 122) and the second arc portion 1242 (i.e. an end of the surround 124 close to the vibrating member 122), such that a return force may also be balanced when the vibrating member vibrates. Accordingly, the bass effect generated by the vibrating member can also be enhanced effectively.

In another embodiment, the invention may only add the reinforcing rib 128 to the first arc portion 1240, so as to balance a tension force difference between the first arc portion 1240 (i.e. an end of the surround 124 away from the vibrating member 122) and the second arc portion 1242 (i.e. an end of the surround 124 close to the vibrating member 122), such that a return force may also be balanced when the vibrating member vibrates. Accordingly, the bass effect generated by the vibrating member can also be enhanced effectively.

In another embodiment, the invention may only increase the thickness of the first arc portion 1240, so as to balance a tension force difference between the first arc portion 1240 (i.e. an end of the surround 124 away from the vibrating member 122) and the second arc portion 1242 (i.e. an end of the surround 124 close to the vibrating member 122), such that a return force may also be balanced when the vibrating member vibrates. Accordingly, the bass effect generated by the vibrating member can also be enhanced effectively.

As mentioned in the above, the invention may selectively increase the thickness of the strengthening rib corresponding to the first arc portion, add the reinforcing rib to the first arc portion, and/or increase the thickness of the first arc portion, so as to balance a tension force difference between the first arc portion (i.e. an end of the surround away from the vibrating member) and the second arc portion (i.e. an end of the surround close to the vibrating member), such that a return force is more balanced when the vibrating member vibrates. Accordingly, the bass effect generated by the vibrating member can be enhanced effectively.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A passive radiator comprising:

a frame;

a vibrating member disposed in the frame;

a surround comprising a first arc portion and a second arc portion, the first arc portion being connected to the frame, the second arc portion being connected to the vibrating member, the first arc portion and the second arc portion being connected to form an S shape; and a plurality of strengthening ribs, each of the strengthening ribs being connected to the first arc portion and the second arc portion simultaneously, a width of the strengthening rib corresponding to the first arc portion in a direction different from a vibrating direction of the vibration member being larger than a width of the strengthening rib corresponding to the second arc portion in the direction different from the vibrating direction of the vibration member.

2. The passive radiator of claim 1, wherein the width of the strengthening rib in the direction different from the vibrating direction of the vibration member decreases gradually from the first arc portion to the second arc portion.

3. The passive radiator of claim 1, further comprising a plurality of reinforcing ribs connected to the first arc portion.

4. The passive radiator of claim 1, wherein a thickness of the first arc portion is larger than a thickness of the second arc portion.

5. A passive radiator comprising:

a frame;

a vibrating member disposed in the frame;

a surround comprising a first arc portion and a second arc portion, the first arc portion being connected to the frame, the second arc portion being connected to the vibrating member, the first arc portion and the second arc portion being connected to form an S shape;

a plurality of reinforcing ribs extending along an arc surface of a concave side of the first arc portion and being connected to the arc surface of the concave side of the first arc portion directly; and a plurality of strengthening ribs connected to the first arc portion and the second arc portion, a width of the strengthening rib corresponding to the first arc portion in a direction different from a vibrating direction of the vibration member being larger than a width of the strengthening rib corresponding to the second arc portion in the direction different from the vibrating direction of the vibration member.

6. The passive radiator of claim 5, wherein the width of the strengthening rib in the direction different from the vibrating direction of the vibration member decreases gradually from the first arc portion to the second arc portion.

7. The passive radiator of claim 5, wherein a thickness of the first arc portion is larger than a thickness of the second arc portion.

8. A passive radiator comprising:

a frame;

a vibrating member disposed in the frame; and a surround comprising a first arc portion and a second arc portion, the first arc portion being connected to the frame, the second arc portion being connected to the vibrating member, the first arc portion and the second arc portion being connected to form an S shape, a thickness of the first arc portion being larger than a thickness of the second arc portion, and the thickness of the first arc portion increasing from an end of the first arc portion connected to the frame to a center portion of the first arc portion and decreasing from the center portion of the first arc portion to another end of the first arc portion connected to the second arc portion.

9. The passive radiator of claim 8, further comprising a plurality of strengthening ribs connected to the first arc portion and the second arc portion, a width of the strengthening rib corresponding to the first arc portion in a direction different from a vibrating direction of the vibration member being larger than a width of the strengthening rib corresponding to the second arc portion in the direction different from the vibrating direction of the vibration member.

10. The passive radiator of claim 9, wherein the width of the strengthening rib in the direction different from the vibrating direction of the vibration member decreases gradually from the first arc portion to the second arc portion.

11. The passive radiator of claim 8, further comprising a plurality of reinforcing ribs connected to the first arc portion.

12. A passive radiator comprising:

a frame;

a vibrating member disposed in the frame;

a surround comprising a first arc portion and a second arc portion, the first arc portion being connected to the frame, the second arc portion being connected to the vibrating member, the first arc portion and the second arc portion being connected to form an S shape, a thickness of the first arc portion being larger than a thickness of the second arc portion, and the thickness of the second arc portion is constant; and a plurality of reinforcing ribs extending along an arc surface of a concave side of the first arc portion and being connected to the arc surface of the concave side of the first arc portion directly.

13. The passive radiator of claim 12, further comprising a plurality of strengthening ribs connected to the first arc portion and the second arc portion, a width of the strengthening rib corresponding to the first arc portion in a direction different from a vibrating direction of the vibration member being larger than a width of the strengthening rib corresponding to the second arc portion in the direction different from the vibrating direction of the vibration member.

14. The passive radiator of claim 13, wherein the width of the strengthening rib in the direction different from the vibrating direction of the vibration member decreases gradually from the first arc portion to the second arc portion.

* * * * *